US008572792B2

(12) United States Patent
Sandkleiva

(10) Patent No.: US 8,572,792 B2
(45) Date of Patent: Nov. 5, 2013

(54) CLEANING TOOL FOR A PIPE

(75) Inventor: Are Sandkleiva, Kvernaland (NO)

(73) Assignee: Aker Well Service AS (NO)

( * ) Notice: Subject to any disclaimer, the term of this patent is extended or adjusted under 35 U.S.C. 154(b) by 903 days.

(21) Appl. No.: 12/095,965

(22) PCT Filed: Dec. 5, 2006

(86) PCT No.: PCT/NO2006/000460
§ 371 (c)(1),
(2), (4) Date: Aug. 28, 2008

(87) PCT Pub. No.: WO2007/067066
PCT Pub. Date: Jun. 14, 2007

(65) Prior Publication Data

US 2009/0320222 A1 Dec. 31, 2009

(30) Foreign Application Priority Data

Dec. 5, 2005 (NO) ..... 20055737

(51) Int. Cl.
*B08B 9/045* (2006.01)

(52) U.S. Cl.
USPC ..... 15/104.13; 15/104.15; 175/365; 166/170

(58) Field of Classification Search
USPC ..... 15/104.13, 104.14, 104.15, 104.31; 175/334, 349, 354, 345, 365; 166/170
See application file for complete search history.

(56) References Cited

U.S. PATENT DOCUMENTS

| | | | | | |
|---|---|---|---|---|---|
| 223,230 | A | * | 1/1880 | Jenkins | 125/5 |
| 677,119 | A | * | 6/1901 | Cramer | 15/104.13 |
| 743,782 | A | * | 1/1904 | Weinland | 100/16 |
| 906,898 | A | * | 12/1908 | Krause | 15/104.13 |
| 928,432 | A | | 7/1909 | Elliott | |
| 1,010,143 | A | * | 11/1911 | Hughes | 175/228 |
| 1,010,144 | A | * | 11/1911 | Hughes | 175/349 |
| 1,133,262 | A | * | 3/1915 | Casaday | 15/104.13 |
| 1,143,272 | A | * | 6/1915 | Hughes | 175/378 |
| 1,247,839 | A | * | 11/1917 | Hughes | 175/367 |
| 1,337,913 | A | * | 4/1920 | Humason | 175/346 |
| 1,431,840 | A | * | 10/1922 | Nidland | 15/104.14 |
| 1,641,312 | A | * | 9/1927 | Bertone | 15/104.14 |
| 1,663,332 | A | * | 3/1928 | Bull | 175/368 |
| 1,733,512 | A | * | 10/1929 | Parker | 15/104.31 |
| 1,762,504 | A | * | 6/1930 | Bull | 175/319 |
| 1,781,413 | A | * | 11/1930 | Slocombe et al. | 175/313 |

(Continued)

OTHER PUBLICATIONS

"Helix." The Free Dictionary. Collins English Dictionary—Complete and Unabridged. HarperCollins Publishers 1991, 1994, 1998, 2000, 2003.*

(Continued)

*Primary Examiner* — Joseph J Hail
*Assistant Examiner* — Joel Crandall
(74) *Attorney, Agent, or Firm* — Andrus, Sceales, Starke & Sawall, LLP

(57) ABSTRACT

A cleaning tool for a pipe, the cleaning tool being moved inside the pipe while rotating in the main about the longitudinal axis of the pipe, and the cleaning tool including, in addition to a mount, at least two cleaning bodies which are rotatable about their respective individual shafts, the cleaning bodies being provided with an uneven surface, at least part of the external active uneven surface of the cleaning bodies facing the internal mantle surface of the pipe.

19 Claims, 4 Drawing Sheets

(56) References Cited

U.S. PATENT DOCUMENTS

| | | | | | |
|---|---|---|---|---|---|
| 2,025,009 | A | | 12/1935 | Baker | |
| 2,039,551 | A | * | 5/1936 | Phipps | 175/354 |
| 2,065,436 | A | * | 12/1936 | Ervin | 175/365 |
| 2,138,009 | A | * | 11/1938 | Keebler | 15/104.14 |
| 2,150,806 | A | * | 3/1939 | McDermet et al. | 15/104.13 |
| 2,257,448 | A | * | 9/1941 | Baker | 15/104.13 |
| 2,272,640 | A | * | 2/1942 | Keebler et al. | 15/104.14 |
| 2,418,880 | A | * | 4/1947 | Haynes et al. | 15/104.061 |
| 2,500,238 | A | * | 3/1950 | Baker et al. | 15/104.13 |
| 2,528,300 | A | * | 10/1950 | Degner | 175/377 |
| 2,887,301 | A | * | 5/1959 | Day | 175/334 |
| 3,850,256 | A | * | 11/1974 | McQueen | 175/228 |
| 4,399,878 | A | * | 8/1983 | Karlsson et al. | 175/227 |
| 5,090,079 | A | * | 2/1992 | Allison et al. | 15/104.31 |
| 6,119,797 | A | * | 9/2000 | Hong et al. | 175/336 |
| 6,174,381 | B1 | | 1/2001 | Ignatiev et al. | |
| 6,533,051 | B1 | * | 3/2003 | Singh et al. | 175/371 |
| 7,090,034 | B2 | * | 8/2006 | Rives | 175/53 |
| 7,152,701 | B2 | * | 12/2006 | Butland et al. | 175/334 |
| 7,195,086 | B2 | * | 3/2007 | Aaron et al. | 175/374 |

OTHER PUBLICATIONS

International Search Report for parent application PCT/NO2006/000460, having a mailing date of Feb. 5, 2007.

* cited by examiner

CLEANING TOOL FOR A PIPE

CROSS-REFERENCE TO RELATED APPLICATIONS

This application is the U.S. national stage application of International Application No. PCT/NO2006/000460, filed Dec. 5, 2006, which International application was published on Jun. 14, 2007, as International Publication No. WO 2007/067066 A1 in the English language, which application is incorporated herein by reference. The International application claims priority of Norwegian Patent Application No. 20055737, filed Dec. 5, 2005, which application is incorporated herein by reference.

BACKGROUND OF THE INVENTION

This invention relates to a cleaning tool for a pipe. More particularly, it relates to a cleaning tool which is moved inside the pipe while rotating about the longitudinal axis of the pipe, the cleaning tool including, in addition to a mount, at least two cleaning bodies which are rotatable about their respective individual shafts. The bodies are provided with an uneven surface, at least part of the external active uneven surface of the cleaning bodies facing the internal mantle surface of the pipe. The cleaning tool is particularly well suited for removing scales in a pipe.

In the further description the cleaning of a pipe with scales has been taken as a basis, such an operation adequately emphasizing the advantageous features of the cleaning tool. However, the range of use of the cleaning tool is not in any way limited to such work, as it will be useable for a number of operations in which pipes or boreholes are to be cleaned or expanded, and in which a so-called "pilot hole" is present.

During the operation of pipe systems of different kinds, it is well known that, with time, scales may build up on the internal mantle surface of the pipe. This is particularly unfavorable when long pipes are involved, to which access is difficult and in which chemical cleaning methods are not very effective.

It is known to use so-called cleaning pigs for the cleaning of pipes. The cleaning pig is moved through a pipe by means of differential pressure and scrapes away scales from the pipe mantle. However, there is a limit to how large pressure difference that may be used and, thus, how large feeding force the cleaning pig may be subjected to.

Thus, with relatively considerable scales, for example such as known from the recovery of petroleum, cleaning equipment resembling a drill bit has to be used, in which the drill bit is driven by, for example, a rotating drill string or coiled tubing. It is evident that the rigging of such equipment is relatively extensive, and it has also turned out that the equipment may damage the pipe if, for example, the drill bit jams in the pipe.

SUMMARY OF THE INVENTION

The invention has as its object to remedy or reduce at least one of the drawbacks of the prior art.

The object is achieved in accordance with the invention through the features specified in the description below and in the Claims that follow.

According to the invention, in a cleaning tool which is moved inside the pipe while rotating about the longitudinal axis of the pipe, the cleaning tool includes in addition to a mount, at least two cleaning bodies which are rotatable about their respective individual shafts, at least part of the external active uneven surface of the cleaning bodies facing the internal mantle surface of the pipe.

It is advantageous that principally the individual shafts extend tilted from the centre axis of the pipe rearwards relative to the working direction of the cleaning tool. The number of cleaning bodies and, thereby, shafts must be at least two, but with three or four as preferred embodiments, to achieve a favorable cleaning effect.

In a preferred embodiment the cleaning bodies have been given a conical shape which has its smallest diameter in the feeding direction. At its opposite end portion, where the conical shape has its largest diameter, the cone merges into a spherical shape.

This spherical part of the cleaning body is thus disposed near the internal mantle surface of the pipe.

The cleaning bodies are formed with an uneven surface. Most advantageously, the cleaning bodies belonging to a cleaning tool are formed with unevennesses of different patterns. For example, one cleaning body may be provided with grooves and ridges extending radially around the cleaning body. A second cleaning body may have grooves and ridges extending helically at an angle to the rotary shaft, whereas a third cleaning body may have grooves and ridges extending helically at an angle in the opposite direction relative to the rotary shaft axis. A fourth cleaning body may be provided with pyramids or cones projecting from the surface of the cleaning body. The operation of said unevennesses will be explained in the particular part of the description.

When the cleaning tool is rotated about the longitudinal axis of the pipe while, at the same time, being moved into the pipe, the cleaning bodies come into contact with scales, first by their spherical portions which are located the nearest to the internal mantle surface of the pipe. Thereby, the cleaning bodies are set into rotation about their respective shafts, thus rolling on the mantle surface of the pipe or the scales present on the mantle surface.

Due to their conical and spherical shapes, the cleaning bodies exert a relatively great force in the radial direction of the pipe. Thereby, the unevennesses of the cleaning bodies are brought to penetrate and break up the scales.

If thicker scales have been allowed to build up, the portion of the scales facing the centre of the pipe will abute the conical portion of the cleaning body. The cleaning bodies, which are rotating about their respective axes of rotation, will tear up and loosen these inner layers of scales.

The cleaning tool is not suitable for the cleaning of completely blocked pipes, as the cleaning tool requires a pilot hole in order to be moved forward.

The cleaning tool enables the loosening of, for example, scales by the use of a relatively small displacement force in the longitudinal direction of the pipe. The necessary torque on the cleaning tool is also, due to the rolling contact of the cleaning bodies, relatively modest. The cleaning tool may, with advantage, be mounted on a downhole tractor's drive shaft, which rotates about the centre axis of the pipe, or on coiled tubing.

BRIEF DESCRIPTION OF THE DRAWINGS

In what follows, is described a non-limiting example of a preferred embodiment which is visualized in the accompanying drawings, in which.

Figure 1:
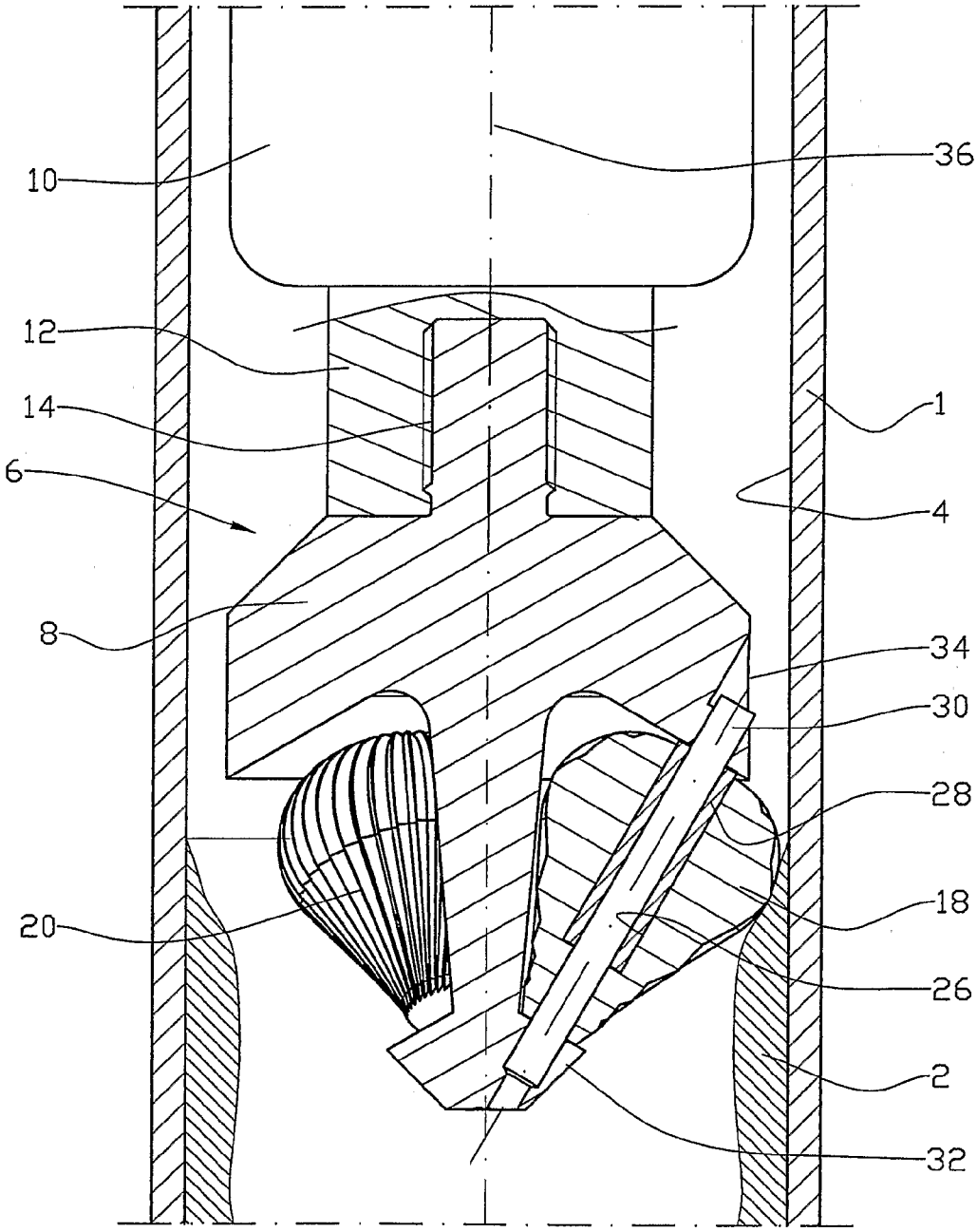
FIG. 1 shows, in section, a cleaning tool according to the invention, which is connected to a downhole tractor and which is in a pipe under cleaning.
Figure 2:
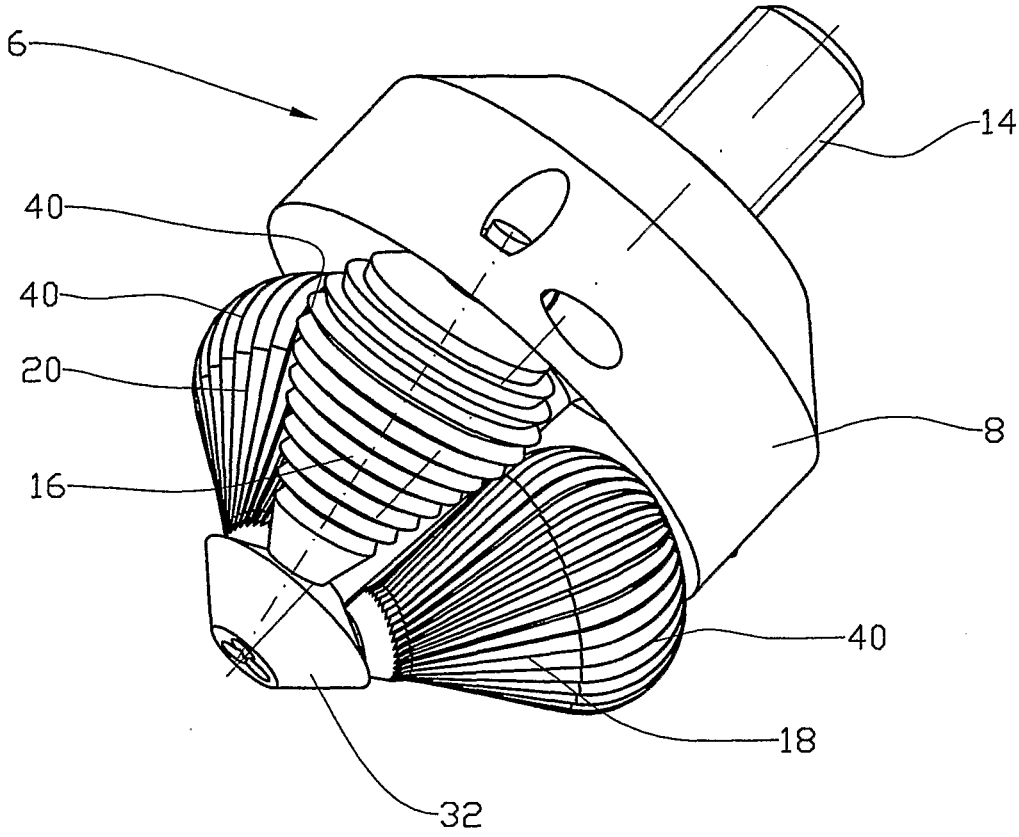
FIG. 2 shows a perspective view of the cleaning tool.

DETAILED DESCRIPTION OF THE DRAWINGS.

In the drawings the reference numeral 1 indicates a pipe where scale layer 2 has been built up on the internal mantle surface 4 of the pipe 1.

A cleaning tool 6 includes a mount 8 which is connected to the drive shaft 12 of a downhole tractor 10 by means of a threaded connection 14.

Figure 3:
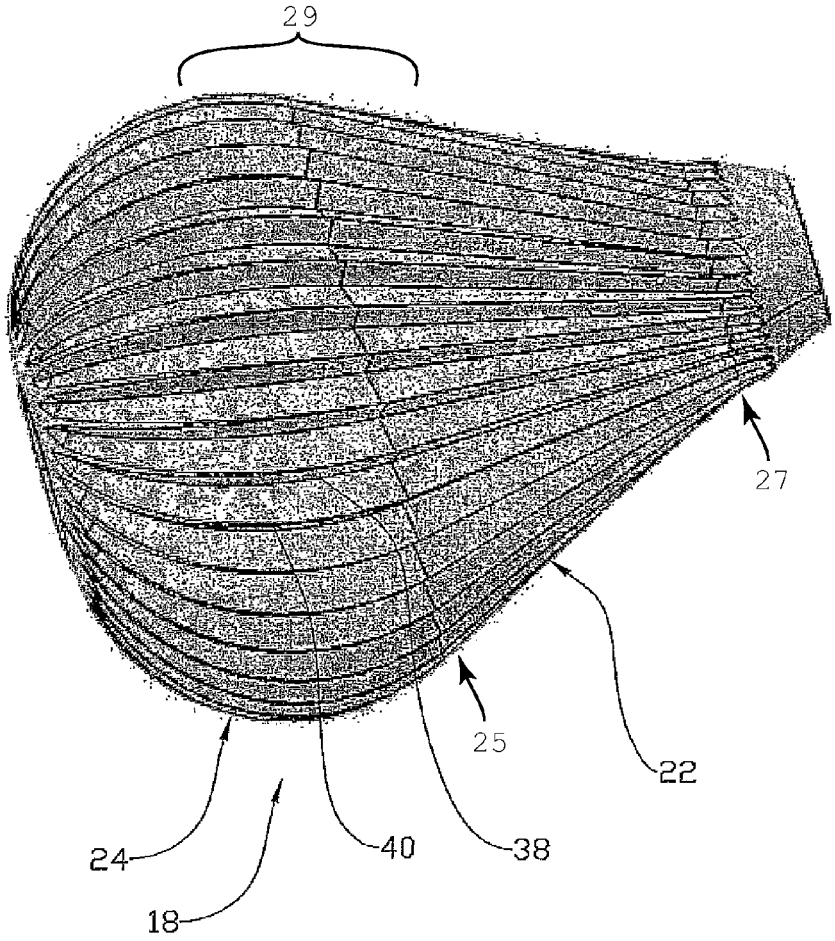
FIG. 3 shows a side view of a cleaning body.

The cleaning tool 6 is provided with a first cleaning body 16, a second cleaning body 18 and a third cleaning body 20. The first cleaning body 16 is not shown in FIG. 1. FIG. 3 shows the second cleaning body 18.

The cleaning bodies 16, 18 and 20 are formed with a conical portion 22 merging into a spherical portion 24, see FIG. 3. In a central through bore 26 in the cleaning bodies 16, 18, 20 is arranged a bushing 28 which is rotatable about a shaft 30.

As shown in FIG. 3, each cleaning body has an upper truncated sphere portion 24 that smoothly transitions into the lower conical portion 22. The lower conical portion 22 has an upper end 25 and a lower end 27. The upper end 25 has a larger outer diameter than the lower end 27. The upper truncated sphere portion 24 has an outer diameter that is larger than the outer diameter of the upper end 25 of the lower conical portion such that a smooth curvilinear transition 29 joins the upper truncated sphere portion 24 and the lower conical portion 22.

The shafts 30 extend between a central projection 32 at the free end portion of the mount 8 and at an angle outwards to the external cylinder surface 34 of the mount 8. The shafts 30 are evenly spaced around the centre axis 36 of the pipe 1.

The cleaning bodies 16, 18, 20 are arranged around their respective shafts 30, the smallest diameter of the conical portion 22 facing the projection 32, whereas the spherical portion 24 is the nearest to the external cylinder surface 34.

Each of the cleaning bodies 16, 18, 20 is provided with grooves 38 and relatively sharp ridges 40, see FIG. 3. The first cleaning body 16 is provided with ridges 40 extending radially, surrounding the first cleaning body 16. The second cleaning body 18 has ridges 40 extending in a right-handed helical shape, whereas the third cleaning body 20 is provided with ridges 40 extending in a left-handed helical shape.

When the cleaning tool 6 is rotated about the centre axis 36 while, at the same time, being moved into the pipe 1, the cleaning bodies 16, 18, 20 engage the scale 2, as is illustrated in FIG. 1.

The cleaning bodies 16, 18, 20 are set into rotation about their respective shafts 30 and the ridges 40 are forced into the scale 2.

Figure 4:
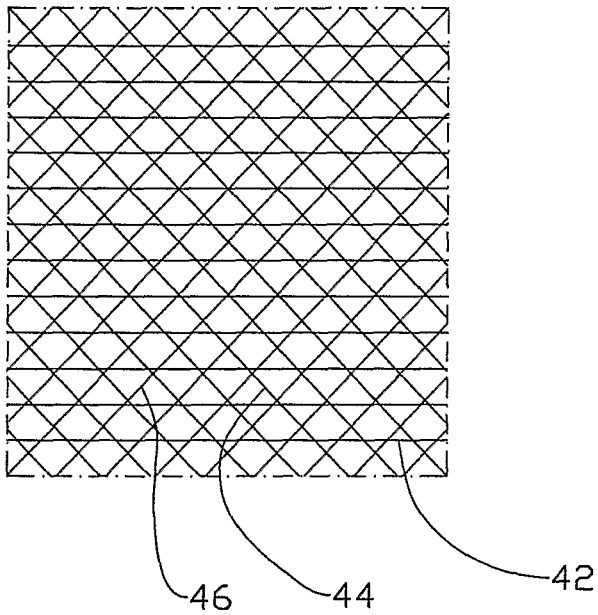
FIG. 4 shows a cleaning pattern from the cleaning tool of FIG. 2.

FIG. 4 shows a pattern, in which the ridges 40 of the first cleaning body 16 leave the traces 42 in the scale 2. If the scale 2 is not broken up sufficiently, the second cleaning body 18 comes and imparts the traces 44 to the scale, whereas the traces 46 stem from the third cleaning body 20 rolling next across the scale 2.

The different patterns from ridges 40 of the cleaning bodies 16, 18, 20 thus have the effect that the scale 2 is given a relatively fine-meshed trace pattern 42, 44, 46 which contributes to breaking up efficiently the scale 2.

The invention claimed is:

1. A cleaning tool for a pipe having an internal mantle surface, the cleaning tool being moved inside the pipe in a feeding direction while rotating about an axis of rotation that is parallel to a central longitudinal axis of the pipe, the cleaning tool comprising:

a mount that extends along the axis of rotation from an upper end to a lower end;

at least two cleaning bodies, each cleaning body being coupled to the mount by a respective shaft, each cleaning body being rotatable, and each cleaning body and respective shaft extending at an angle to the axis of rotation, inwardly towards the lower end of the mount;

wherein each cleaning body comprises an external surface that at least partially faces the internal mantle surface of the pipe and that tapers inwardly towards the lower end of the mount;

wherein each of the cleaning bodies is formed of an upper truncated sphere portion that smoothly transitions into a lower conical portion, the lower conical portion having an upper end and a lower end, the upper end having a larger outer diameter than the lower end, wherein the upper truncated sphere portion has an outer diameter that is larger than the outer diameter of the upper end of the lower conical portion such that a smooth transition joins the upper truncated sphere portion and the lower conical portion;

each cleaning body and respective shaft being oriented with respect to the mount such that as the cleaning tool is rotated about the axis of rotation and moved inside the pipe in the feeding direction, each cleaning body contacts scales on the internal mantle surface of the pipe, and such that scales that extend inwardly from the internal mantle surface of the pipe towards the central longitudinal axis are contacted by both the upper truncated sphere portion and the lower conical portion of the cleaning bodies.

2. The cleaning tool according to claim 1, wherein the respective shafts substantially extend at a 55 degree angle with respect to the axis of rotation.

3. The cleaning tool in accordance with claim 1, wherein the ridges of at least one of the cleaning bodies radially surround at least one of the upper truncated sphere portion and the lower cone portion.

4. The tool according to claim 1, wherein at least one of the cleaning bodies comprises an outer surface having ridges extending radially around at least one of the upper truncated sphere portion and the lower cone portion and wherein at least another one of the cleaning bodies comprises an outer surface having ridges extending helically around that cleaning body.

5. The tool according to claim 1, wherein at least one of the cleaning bodies comprises an outer surface comprising ridges extending helically around that cleaning body in a right handed shape and wherein at least another one of the cleaning bodies comprises an outer surface having ridges extending helically around that cleaning body in a left handed shape.

6. The tool according to claim 1, wherein at least one of the cleaning bodies comprises an outer surface comprising pyramids extending from that cleaning body and wherein at least another one of the cleaning bodies comprises an outer surface having ridges extending helically around that cleaning body.

7. The tool according to claim 1, wherein at least one of the cleaning bodies comprises an outer surface comprising pyramids extending from that cleaning body and wherein the at least another one of the cleaning bodies comprises an outer surface having ridges extending radially around at least one of the upper truncated sphere portion and lower cone portion.

8. The tool according to claim 1, wherein at least one of the cleaning bodies comprises an outer surface comprising cones extending from that cleaning body and wherein at least another one of the cleaning bodies comprises an outer surface having ridges extending helically around that cleaning body.

9. The tool according to claim 1, wherein at least one of the cleaning bodies comprises an outer surface comprising cones extending from that cleaning body and wherein at least another one of the cleaning bodies comprises an outer surface having ridges extending radially around at least one of the upper truncated sphere portion and the lower cone portion.

10. A cleaning tool according to claim 1, comprising a central projection disposed at the lower end of the mount, and wherein the respective shafts of the cleaning bodies extend between the central projection and an external portion of the mount.

11. A cleaning tool for a pipe having an internal mantle surface, the cleaning tool being moved inside the pipe in a feeding direction while rotating about an axis of rotation that is parallel to a central longitudinal axis of the pipe, the cleaning tool comprising:

a mount that extends along the axis of rotation from an upper end to a lower end;

at least two cleaning bodies, each cleaning body being coupled to the mount by a respective shaft, each cleaning body being rotatable, and each cleaning body and respective shaft extending at an angle to the axis of rotation, inwardly towards the lower end of the mount;

wherein each cleaning body comprises an external surface that at least partially faces the internal mantle surface of the pipe and that tapers inwardly towards the lower end of the mount;

wherein each of the cleaning bodies is formed of an upper truncated sphere portion that smoothly transitions into a lower conical portion;

each cleaning body and respective shaft being oriented with respect to the mount such that as the cleaning tool is rotated about the axis of rotation and moved inside the pipe in the feeding direction, each cleaning body contacts scales on the internal mantle surface of the pipe, and such that scales that extend inwardly from the internal mantle surface of the pipe towards the central longitudinal axis are contacted by both the upper truncated sphere portion and the lower conical portion of the cleaning bodies;

a central projection disposed at the lower end of the mount, and wherein the respective shafts of the cleaning bodies extend between the central projection and an external portion of the mount.

12. The cleaning tool according to claim 11, wherein the respective shafts substantially extend at a 55 degree angle with respect to the axis of rotation.

13. The cleaning tool in accordance with claim 11, wherein the ridges of at least one of the cleaning bodies radially surround at least one of the upper truncated sphere portion and the lower cone portion.

14. The tool according to claim 11, wherein at least one of the cleaning bodies comprises an outer surface having ridges extending radially around at least one of the upper truncated sphere portion and the lower cone portion and wherein at least another one of the cleaning bodies comprises an outer surface having ridges extending helically around that cleaning body.

15. The tool according to claim 11, at least one of the cleaning bodies comprises an outer surface comprising ridges extending helically around that cleaning body in a right handed shape and wherein at least another one of the cleaning bodies comprises an outer surface having ridges extending helically around that cleaning body in a left handed shape.

16. The tool according to claim 11, wherein at least one of the cleaning bodies comprises an outer surface comprising pyramids extending from that cleaning body and wherein at least another one of the cleaning bodies comprises an outer surface having ridges extending helically around that cleaning body.

17. The tool according to claim 11, wherein at least one of the cleaning bodies comprises an outer surface comprising pyramids extending from that cleaning body and wherein the at least another one of the cleaning bodies comprises an outer surface having ridges extending radially around at least one of the upper truncated sphere portion and lower cone portion.

18. The tool according to claim 11, wherein at least one of the cleaning bodies comprises an outer surface comprising cones extending from that cleaning body and wherein at least another one of the cleaning bodies comprises an outer surface having ridges extending helically around cleaning body.

19. The tool according to claim 11, wherein at least one of the cleaning bodies comprises an outer surface comprising cones extending from that cleaning body and wherein at least another one of the cleaning bodies comprises an outer surface having ridges extending radially around at least one of the upper truncated sphere portion and the lower cone portion.

* * * * *